US005365618A

United States Patent [19]

Gilbert

[11] Patent Number: 5,365,618

[45] Date of Patent: Nov. 22, 1994

[54] SUPPORT SYSTEM FOR BATHER'S LIFT

[76] Inventor: Lloyd Gilbert, 4241 Colt Dr., Lake Havasu, Ariz. 86403

[21] Appl. No.: 215,697

[22] Filed: Mar. 22, 1994

[51] Int. Cl.[5] ..... A47K 3/12

[52] U.S. Cl. ..... 4/563.1; 4/560.1; 414/921; 248/200.1

[58] Field of Search ..... 4/496, 560.1, 561.1, 4/562.1, 563.1, 564.1, 565.1, 566.1, 610, 611; 5/83.1, 87.1; 248/200.1, 519; 414/921, 540, 541

[56] References Cited

U.S. PATENT DOCUMENTS

| | | | |
|---|---|---|---|
| 2,187,283 | 1/1940 | Scheutz | 4/561.1 X |
| 2,594,605 | 4/1952 | Zoppelt | 248/200.1 X |
| 2,679,890 | 6/1954 | Zannoth | 4/560.1 X |
| 2,779,949 | 2/1957 | Crispen | 4/563.1 |
| 2,919,134 | 12/1959 | Zuro | 248/200.1 X |
| 2,930,499 | 3/1960 | Landen | 414/541 |
| 3,078,473 | 2/1963 | Daniels | 4/563.1 |
| 3,123,400 | 3/1964 | Paulson | 4/560.1 X |
| 3,413,662 | 12/1968 | Stayton | 4/562.1 |
| 3,917,208 | 11/1975 | Magers | 248/200.1 |
| 3,918,108 | 11/1975 | Feyerherm | 4/563.1 |
| 3,981,484 | 9/1976 | James | 4/564.1 X |
| 3,994,030 | 11/1976 | Cassell et al. | 4/563.1 |
| 5,263,207 | 11/1993 | Gilbert | 4/562.1 |

*Primary Examiner*—Robert M. Fetsuga
*Attorney, Agent, or Firm*—LaValle D. Ptak

[57] ABSTRACT

A support system for a bather's lift for aiding invalids to enter and exit a bathtub is constructed so that the lift assembly may readily be removed and stored away when it is not in use. The system includes a vertical column for supporting the lift. This column has a lower end, which engages a mating projection on a floor plate. The floor plate, in turn, is not bolted to the floor, but includes a pair of downwardly extending lugs which fit into corresponding recesses in the floor. At the upper end, the vertical column has an extension, which passes through a mating hole in a support bar extending parallel to the bathtub and attached to the end walls at each end of the bathtub. This support bar may be used as a shower curtain rod; but when the extension on the end of the vertical column for stabilizing and supporting the seat support passes into it, the entire assembly is rigidly held in place for use of the seat. A releasable fastener is used to secure the extension at the upper end of the vertical column into the hole in the support bar, when the seat is in use.

13 Claims, 1 Drawing Sheet

SUPPORT SYSTEM FOR BATHER'S LIFT

RELATED PATENT

This application is related to U.S. Pat. No. 5,263,207, issued on Nov. 23, 1993 to Lloyd H. Gilbert.

BACKGROUND

A variety of different devices have been designed to facilitate the movement of invalids from a seated position in wheelchair to a seated position in a bathtub. Basic to the design of most of these devices, is a lift utilizing a vertical column, which operates a seat support to raise and lower a person in the seat. The seat support also is made rotatable; so that the person may enter the seat from outside the bathtub, be rotated to a position over the water in the tub, and then lowered into the tub. When the bath is finished, the process is reversed. Many such installations require substantial modification to the bathtub region; and frequently, the devices consume a considerable amount of the available space in and around the tub. Many such devices require professional installation, and the installation is permanent or semi-permanent in nature.

A device representative of an effort to simplify a bather's lift installation is shown in the Feyerherm U.S. Pat. No. 3,918,108. The device of this patent is attached over the edge of the tub; so that all of the side-to-side stress is carried by the tub itself. There is no upper and lower connection; but tile vertical shaft which holds the seat extends through a tube on the side of an inverted "U-shaped" device, which fits over the edge of the tub. With the widespread use of fiberglass tubs having relatively thin sidewalls, the device of this patent very well may place sufficient stress on such a tub as to break it, crack it, or otherwise damage the integrity of the tub. Because the weight of the person in the seat is all pressed against the tub itself, it appears that this device is primarily suitable only for cast iron tubs.

The patent to Daniels U.S. Pat. No. 3,708,473 does not require any holes to be drilled, either at the lower end or the upper end of the seat support column. The device of the Daniels patent, however, must be fitted over the end of the tub, where the lower part of the weight rests. For the upper end, a turnbuckle is used to wedge a plate, to which the top of the device is welded, against the wall. This is an installation which, in most cases, needs to be made by a handyman. In addition, the device itself limits the use of the tub by non-handicapped persons.

A different approach is disclosed in the patent to Cassell U.S. Pat. No. 3,994,030. The bathtub lift of this patent requires it to be attached to the wall, and it rests on the edge of the bathtub at the lower end; so that the tub must carry all of the weight.

Another approach is shown in the device of the Crispen patent U.S. Pat. No. 2,779,949. This device must be lifted over and into the tub; and a pair of arms extend outwardly on each side to rest over the edge of the tub to carry the weight. The mechanism of this patent would be difficult for many people to install and remove.

A simple and easy to use assembly is disclosed in the above identified patent to Gilbert U.S. Pat. No. 5,263,207. The lift disclosed in this patent is a hydraulic lift. As disclosed in the Gilbert patent U.S. Pat. No. 5,263,207, however, the installation requires a plate to be bolted to the floor, and another plate to be bolted into the ceiling for supporting a vertical slide shaft for use with the hydraulic lift. Because of the bolted plate at the ceiling and the bolted plate on the floor, installation in most cases needs to be made by a handyman. To remove the assembly illustrated in the Gilbert patent '207, when a multiple section slide shaft is employed, the upper section may be moved upwardly into the ceiling, through the upper support plate to disassemble the two parts of the slide shaft. The parts then may be lifted off the floor support plate and pulled down off the ceiling. When this is done, however, the support plate still remains in place on the floor, unless the bolts are removed. Likewise, the ceiling support plate leaves a hole in the ceiling.

It is desirable to provide a simple support system for a bathtub lift, which is easily installed, which is unobtrusive, and which permits the lift readily to be moved from one location to another.

SUMMARY OF THE INVENTION

It is an object of this invention to provide an improved system for a bather's lift.

It is an additional object of this invention to provide a support system for a bather's lift, which is easy to install and remove.

It is another object of this invention to provide a support system for a bather's lift, which permits installation and removal of the lift without requiring tools.

It is a further object of this invention to provide a support system for a bather's lift, which securely supports the bather's lift when it is in use, and which is unobtrusive after the bather's lift has been removed.

In accordance with a preferred embodiment of this invention, a support system for a bather's lift includes a vertical column with lower and upper ends. A seat and seat support travel vertically adjacent the vertical column to lower and raise a person in the seat. A floor plate located on the floor adjacent the bathtub is secured against movement in a plane parallel to the plane of the floor; and an engagement member on the floor plate extends upwardly to releaseably engage the lower end of the vertical column. A support bar extends parallel to the floor at the top of the column. This support bar is attached between first and second end walls, between which the bathtub is located; and the vertical column is releaseably attached at the upper end to the support bar.

When the bather's lift is no longer needed, it readily may be removed by releasing the vertical column from the support bar and then lifting the lower end of the vertical column off of the engagement member on the floor plate. Provision also is made for facilitating the removal of the floor plate from the floor when it no longer is needed.

DETAILED DESCRIPTION

Reference now should be made to the drawings, in which the same reference numbers are used throughout the different figures to designate the same components.

Figure 1:
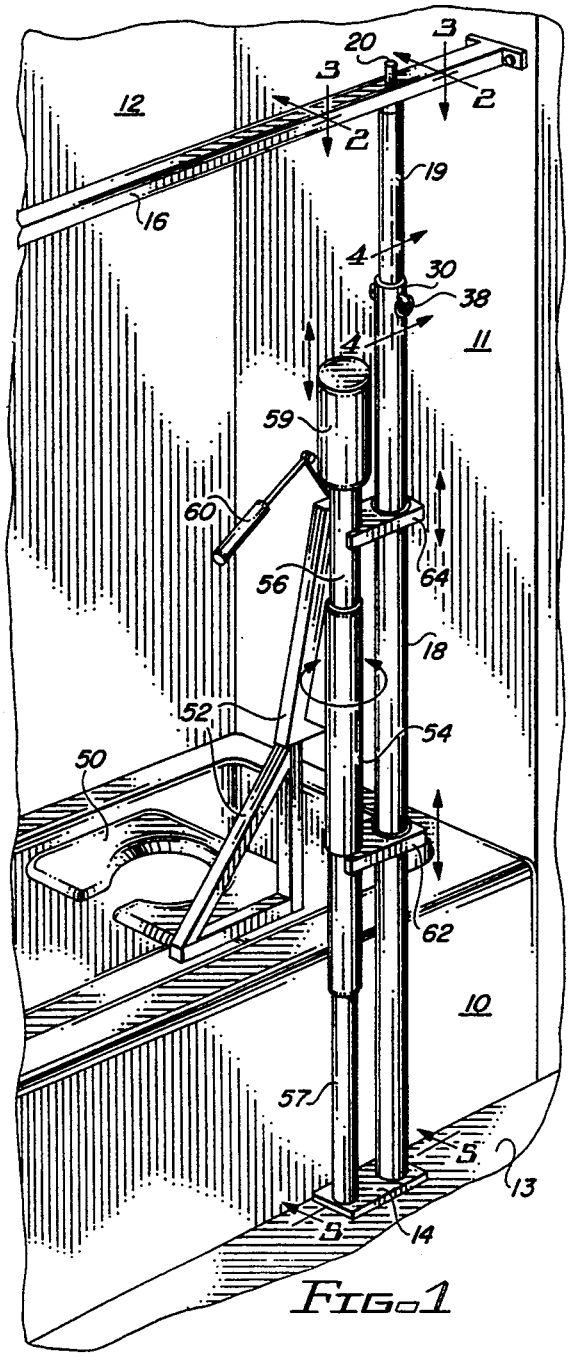
FIG. 1 is a perspective view of a preferred embodiment of the invention, illustrating its manner of use.

FIG. 1 is directed to a bather's lift assembly, which essentially is of the type described in the above identified patent to Gilbert U.S. Pat. No. 5,263,207. As a consequence, the specification and disclosure of the '207 patent is incorporated herein by reference.

As illustrated in FIG. 1, the bather's lift includes a vertical support column, which, as shown in FIG. 1, is a telescoping column with a lower, hollow, tubular portion 18 and an upper, hollow, tubular telescoping portion 19, having an external diameter which is less than the internal diameter of the section 18. This support column is extended between a floor plate 14 and a horizontal support bar or support rod 16, located at the upper end of the telescoping section 19.

The support bar 16 replaces the conventional shower rod and it is fastened above a bathtub 10 in a horizontal position between end walls located at opposite ends of the bathtub. Only one of these end walls 11 is shown along with a back wall 12 on the opposite side of the bathtub from the open side where the vertical support column 18 is located. The support bar 16 is secured by means of 16 bolts, screws or other suitable fasteners to the end walls (only one of which 11 is shown in FIG. 1) to position it for a permanent installation. The location of the bar 16, however, is essentially the same location used for a conventional shower rod, but is made of heavier stock; so that the bar 16 may serve a dual purpose of being used for a shower curtain, as well as forming the upper support for the telescoping vertical column 18/19.

The mechanism constituting the bather's lift is substantially the same as that described in the Gilbert U.S. Pat. No. 5,263,207. A manually-operated hydraulic jack, comprising a cylinder 56, is used to extend a lower piston 57 from the cylinder 56 under actuation of a pump handle 60 coupled to a fluid reservoir 59, in a manner well known in the art. A pair of vertically-spaced slide couplers 62 and 64 are welded or otherwise securely attached to the cylinder 56 of the hydraulic pump, and are slidably mounted over the exterior of the vertical support column section 18. Consequently, as the pump is actuated to move the cylinder 56 up and down with respect to the piston 57, the cylinder itself moves vertically adjacent the column 18 in the direction of the arrows shown on the column 18, through the slide couplers 62 and 64.

A seat 50 is rotatably supported on the cylinder 56 by means of a rotatable support cylinder 54, to which a support frame 52 is welded. This permits rotation of the seat 50 and the support 52 about the cylinder 56, in the direction of the circular arrow shown in FIG. 1. Various provisions may be made for locking the seat 50 in different positions with respect to the cylinder 56 to prevent accidental rotation of the seat. These provisions, however, are not a part of the present invention; and a variety of suitable detents, stops or locks may be used to firmly position the seat 50 both against accidental vertical movement and accidental rotational movement.

Figure 5:
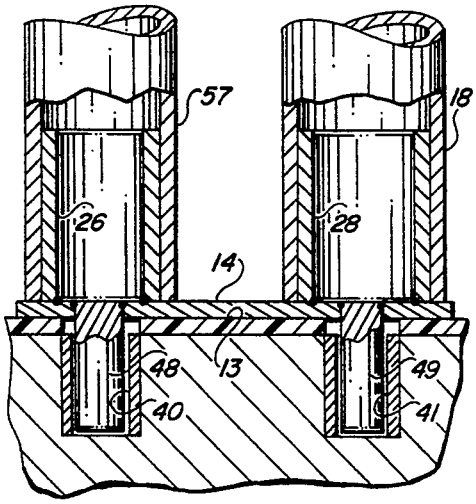
FIG. 5 is a cross-sectional view of a portion of the embodiment of FIG. 1 taken along the line 5—5 of FIG. 1.

As illustrated in FIG. 5, the lower end of the piston 57 and the lower end of the column section 18 both are hollow, and fit, respectively, over a pair of cylindrical studs or projections 26 and 28, secured to and extending upwardly from the floor plate 14. It should be noted that the floor plate 14 also has a pair of fixed, downwardly extending solid cylindrical projections or lugs 48 and 49, located beneath the upward extensions 26 and 28. The lugs or projections 48 and 49 are dimensioned no fit into cylindrical recesses 40 and 41, which are drilled into the floor 13 at the position where the floor plate 14 is to be installed. These holes are shown most clearly in FIG. 6. It should be noted that there is no bolting of the floor plate 14 to the floor, and that it is simply held in place by means of the downwardly extending projections or lugs 48 and 49 inserted into the holes 40 and 41.

Figure 6:
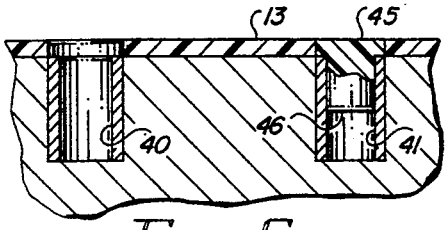
FIG. 6 illustrates a feature of the installation of the embodiment shown in FIG. 1.
Figure 7:
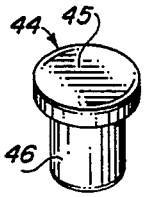
FIG. 7 illustrates a component used in conjunction with the feature shown in FIG. 6.

When the floor plate 14 is removed, a pair of small plastic or metal plugs 44, having an enlarged cap 45 and a downward extension 46, may be placed, as shown in FIG. 6, into the holes 40 and 41 to plug the holes and prevent them from being filled with water or accumulated dirt. In addition, the plugs 44 improve the aesthetic appearance of the bathroom floor 13 when the plate 14 is not in place. If permanent lugs 48 and 49 on the bottom of the plate 14 are not desired, holes may be drilled through the plate 14 in the be dropped into the holes through the open ends of the extensions 26 and 28 to hold the plate 14 in place against lateral movement in the same manner as the lugs 48 and 49, described above.

To install the assembly shown in FIG. 1, the plugs 44 are removed from the holes 40 and 41 in the floor 13; and the projections 48 and 49 of the plate 14 are placed into the holes to locate the plate 14, as shown in FIGS. 1 and 5. The lower ends of the piston 57 and of the vertical support column 18 then are slipped over the cylindrical extensions 26 and 28, as shown in FIG. 5; so that the extensions 26 and 28 are completely covered by the end of the piston 57 and the lower end of the section 18 of the support column. When this is done, water is prevented from entering into the extensions 26 and 28; and an improved aesthetic appearance is achieved. Additional security may be obtained by passing bolts or cotter pins through matching holes (not shown) in the respective lower ends of the piston 57 and column 18 and the extensions 26 and 28.

Figure 2:
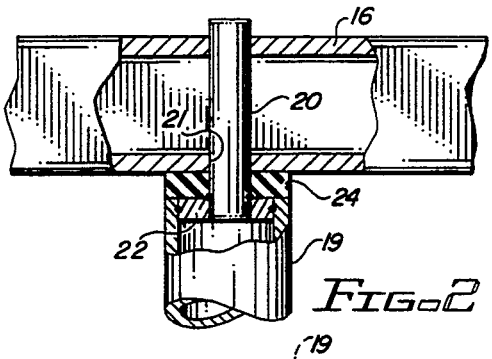
FIG. 2 is a cross-sectional view of a portion of the embodiment of FIG. 1 taken along the line 2—2 of FIG. 1.
Figure 3:
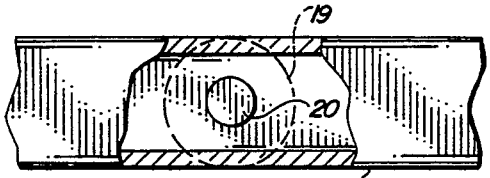
FIG. 3 is a cross-sectional view of a portion of the embodiment shown in FIG. 1 taken along the line 3—3 of FIG. 1.
Figure 4:
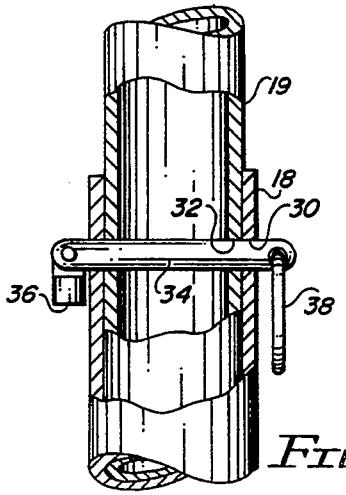
FIG. 4 is a cross-sectional view of a detail of the embodiment shown in FIG. 1 taken along the line 4—4 of FIG. 1.

To anchor the upper end of the telescoping support columns 18/19, a hole 21 is formed or drilled through the upper support bar 16, at a position which centers it over the extension 28 shown in FIG. 5 in the floor plate 14. The upper end of the smaller telescoping cylindrical section 19 has an insert or plug 22 welded or otherwise secured to that end; and a steel pin 20 is welded or secured into the center of the plug 22 to extend upwardly from the upper end of the column 19, as shown most clearly in FIG. 2. The column 19 first is telescoped downwardly into the column 18, beneath the hole 21, and then extended upwardly to the position shown in FIG. 2. In this position, a pair of holes 30 (in the upper end of the section 18) and 32 (near the lower end of the section 19) are aligned with one another; and a locking pin 34 is inserted through the holes 30/32 to secure the upper telescoping section 19 in the position shown in FIGS. 1 and 2. The locking pin may be of any suitable type having a pivoted end 36 to secure it in place once it has been inserted through the holes 30 and 32. On the opposite end, a ring 38 may be provided to facilitate removal of the pin 34 when disassembly of the support system is desired.

From the foregoing it readily can be seen that the set-up and installation of the bather's lift may be effected by unskilled persons without tools, once the holes 40 and 41 are drilled or formed in the floor 13, and the upper support bar 16 has been installed. To remove the device, the pin 34 is pulled out, the upper telescoping section 19 is lowered to clear the pin 20 from the hole 21 in the bar 16. The entire assembly then may be lifted up off the extensions 26 and 28. Once the assembly has been lifted off the extensions 26 and 28 in the plate 14, the plate 14 readily may be lifted out of the holes 40 and 41 by lifting one or the other of the extensions 26 and 28.

It should be noted that when the plate 14 is in place, as shown in FIG. 5, the projections 48 and 49 prevent lateral movement, or movement of the plate in a plane parallel to the floor 13. Although the plate 14 readily may be lifted out of the holes 40 and 41 when the bather's lift is not in place, placement of the lift on the extensions 26 and 28, and securing it an the upper end to the support bar 16, prevents the plate 14 from being lifted up out of the holes 40 and 41. In addition, the weight of the lift on the piston 57 and the lower end of the cylindrical support column section 18 further serves to press the plate 14 downwardly into engagement with the floor 13. The result is a very secure support system, which quickly and readily may be installed and removed with a minimal amount of change in the aesthetic appearance of the bathtub area when the lift is not in place. The lift support system may be used in several bathrooms in a home, or more typically, in the various bathrooms of a hotel or motel. When the lift is not needed, it is removed from the room. However, whenever a lift is required for an invalid desiring to rent the room, the lift quickly and easily may be installed by unskilled personnel in the manner described above.

The foregoing description of the preferred embodiment of the invention should be considered as illustrative, and not as limiting. For example, the support system may be used with other types of lifts, such as electric. Various changes and modifications will occur to those skilled in the art, for performing substantially the same function in substantially the same way, to achieve substantially the same result, without departing from the true scope of the invention as defined in the appended claims.

I claim:

1. A support system for a barber's lift for aiding invalids to enter and exit a bathtub located between first and second end walls, wherein the lift includes a vertical column, with lower and upper ends, and adjacent which a seat and seat support travel vertically to raise and lower a person in the seat, the support system including in combination:

a floor plate for location on a floor adjacent the bathtub;

at least one securing members for securing said floor plane to the floor against movement of said floor plate in a plane parallel to the floor;

an engagement member on said floor plate and extending upwardly therefrom for releaseably engaging the lower end of said vertical column;

a support bar member for being located a predetermined distance above the floor extending parallel to the floor and sized for attachment between the first and second end walls; and connecting means for releaseably attaching the upper end of said vertical column to said support bar, said connecting means comprising a hole extending at least part way through said support bar member, said hole facing said floor plate, and an extension on the upper end of said vertical column dimensioned to fit within the bole in said support bar member.

2. The combination according to claim 1 wherein the lower end of said vertical column and said engagement member on said floor plate comprise telescoping tubular members, one of which fits into the other.

3. The combination according to claim 2 wherein said tubular engagement member has a predetermined outer diameter, and said tubular column is hollow at the lower end thereof ,and has an inner diameter which is not less than the outer diameter of said engagement member.

4. The combination according to claim 3 wherein said securing members for securing said floor plate to a floor include at least first and second spaced downward projections on said floor plate for mating into respective first and second holes in said floor.

5. The combination according to claim 4 wherein said floor plate and said support bar member are located vertically over one another; so that said vertical column extends vertically therebetween.

6. The combination according to claim 5 wherein said extension on the end of said vertical column includes a telescoping tubular section releasably extendable away from and foward said support bar member when the lower end of said vertical column is engaged by said engagement member on said floor plate.

7. The combination according to claim 1 wherein said floor plate and said support bar member are located vertically over one another; so that said vertical column extends vertically therebetween.

8. The combination according to claim 7 wherein the lower end of said vertical column and said engagement member on said floor plate comprise telescoping tubular members, one of which fits into the other.

9. The combination according to claim 8 wherein said tubular engagement member has a predetermined outer diameter, and said tubular column is hollow at the lower end thereof and has an inner diameter which is not less than the outer diameter of said engagement member.

10. The combination according to claim 9 wherein said securing members for securing said floor plate to a floor include at least first and second spaced downward projections on said floor plate for mating into respective first and second holes in said floor.

11. The combination according to claim 1 wherein said extension on the end of said vertical column includes a telescoping tubular section releasably extendable away from and toward said support bar member when the lower end of said vertical column is engaged by said engagement member on said floor plate.

12. The combination according to claim 11 wherein said floor plate and said support bar member are located vertically over one another; so that said vertical column extends vertically therebetween.

13. The combination according to claim 1 wherein said securing members for securing said floor plate to a floor include at least first and second spaced downward projections on said floor plate for mating into respective first and second holes in said floor.

* * * * *